US007770623B2

(12) United States Patent
Wong

(10) Patent No.: US 7,770,623 B2
(45) Date of Patent: Aug. 10, 2010

(54) LOUVRED SHUTTER

(75) Inventor: Lok Yung Wong, 45 Jurong East Ave. 1, #02-04 Parc Oasis, Singapore (SG) 609779

(73) Assignee: Lok Yung Wong, Singapore (SG)

( * ) Notice: Subject to any disclaimer, the term of this patent is extended or adjusted under 35 U.S.C. 154(b) by 0 days.

(21) Appl. No.: 12/524,099

(22) PCT Filed: Nov. 4, 2008

(86) PCT No.: PCT/SG2008/000422

§ 371 (c)(1),
(2), (4) Date: Jul. 24, 2009

(87) PCT Pub. No.: WO2009/067086

PCT Pub. Date: May 28, 2009

(65) Prior Publication Data

US 2010/0012279 A1 Jan. 21, 2010

(30) Foreign Application Priority Data

Nov. 20, 2007 (SG) ..... 200717898-1

(51) Int. Cl.
*E06B 9/08* (2006.01)

(52) U.S. Cl. ..... 160/133; 160/220; 160/229.1

(58) Field of Classification Search ..... 160/133, 160/186, 187, 229.1, 220; 49/74.1, 81.1, 49/92.1

See application file for complete search history.

(56) References Cited

U.S. PATENT DOCUMENTS 31,300 A * 2/1861 Cochrane ..... 160/229.1

(Continued)

FOREIGN PATENT DOCUMENTS

CH 664419 2/1988

(Continued)

*Primary Examiner*—Blair M. Johnson
(74) *Attorney, Agent, or Firm*—Harness, Dickey & Pierce, P.L.C.

(57) ABSTRACT

The invention relates to a shutter for a roller shutter assembly, the shutter comprising a series of shutter panels (10) and a plurality of connecting arms (20). The shutter panels (10) each have an upper edge (11) and a lower edge (12), a first face (13) and a second face (14), and the first faces (18) all face to a first side of the shutter and the second faces (14) all face to an opposite second side of the shutter. The connecting arms (20) each have a lower edge (21) and an upper edge (22), a lower one of two adjacent shutter panels in the series is pivotally connected to a higher one of the two adjacent shutter panels by at least two of the connecting arms (20). The lower edge (21) of each of the at least two connecting arms (20) is pivotally connected to an upper pivotal connection on the first face (13) of the lower of the two adjacent shutter panels, the upper pivotal connection being spaced below the upper edge of the lower shutter panel (10). The upper edge (22) of each of the at least two connecting arms (20) is pivotally connected to a lower pivotal connection on the second face (14) of an upper of the two adjacent shutter panels (10), the lower pivotal connection being spaced above the lower edge (12) of the upper shutter (11) panel (10). The at least two connecting arms (20) are spaced apart along the axes of the pivotal connections between the at least two connecting arms (20) and the upper and lower shutter panels (10).

10 Claims, 11 Drawing Sheets

U.S. PATENT DOCUMENTS

| | | | | | |
|---|---|---|---|---|---|
| 1,638,344 | A | * | 8/1927 | Kocher | 160/113 |
| 1,852,913 | A | * | 4/1932 | Bauer | 160/220 |
| 1,966,728 | A | * | 7/1934 | Lecluyse | 160/220 |
| 3,367,391 | A | | 2/1968 | Toti | |
| 5,575,322 | A | * | 11/1996 | Miller | 160/133 |
| 6,085,822 | A | * | 7/2000 | Miller | 160/133 |

FOREIGN PATENT DOCUMENTS

| | | | |
|---|---|---|---|
| DE | 1237289 | | 3/1967 |
| DE | 102004003029 | A1 | 8/2005 |
| DE | 202005010548 | U1 | 11/2005 |
| DE | 102006005750 | A1 | 8/2007 |
| GB | 191209534 | | 7/1913 |
| WO | 99/41480 | | 8/1999 |
| WO | 2005/033461 | | 4/2005 |

* cited by examiner

LOUVRED SHUTTER

CROSS-REFERENCE TO RELATED APPLICATIONS

This application is a U.S. national stage filing under 35 U.S.C. §371 of International Application No. PCT/SG2008/000422 filed Nov. 4, 2008, published as WO2009/067086 on May 28, 2009, and which claims priority to Singapore Application No. 200717898-1 filed Nov. 20, 2007. The disclosures of the aforementioned applications are incorporated herein by reference in their entireties.

FIELD OF INVENTION

The present invention relates to a louvred shutter than can be raised and lowered, to respectively open and close over an opening.

BACKGROUND

Shutters and grilles for closing over openings are known. Such shutters and grilles may be fixed or may be able to be moved between open and closed states. In many cases, such grilles and shutters can be opened by being tolled up about an axis extending across and above the opening.

Roller shutters and grilles may be assembled from a plurality of pivotally inter-connected slats or bars that are sufficiently articulated to enable the shutter of grille to be tolled up when opened. Roller shutters can be provided by a corrugated sheet that is sufficiently flexible to permit being rolled up when the shutter is opened.

Grilles, and roller shutters using aperatured or perforated shutter slats, have been used to provide security and ventilation when closed. However, these have not provided adequate protection from precipitation such as rain.

SUMMARY OF INVENTION

In broad terms, a first aspect of the invention comprises a shutter for a roller shutter assembly, the shutter comprising a series of shutter panels and a plurality of connecting arms; wherein the shutter panels each have an upper edge and a lower edge, a first face and a second face, and the first faces all face to a first side of the shutter and the second faces all face to an opposite second side of the shutter;

the connecting arms each have a lower edge and an upper edge;

a lower one of two adjacent shutter panels in the series is pivotally connected to a higher one of the two adjacent shutter panels by at least two of the connecting arms;

the lower edge of each of the at least two connecting arms is pivotally connected to an upper pivotal connection on the first face of the lower of the two adjacent shutter panels, the upper pivotal connection being spaced below the upper edge of the lower shutter panel;

the upper edge of each of the at least two connecting arms is pivotally connected to a lower pivotal connection on the second face of an upper of the two adjacent shutter panels, the lower pivotal connection being spaced above the lower edge of the upper shutter panel; and the at least two connecting arms are spaced apart along the axes of the pivotal connections between the at least two connecting arms and the upper and lower shutter panels.

Preferably, each of the two adjacent shutter panels has upper and lower pivotal connections lying on respective opposite faces of a planar mid-portion of the shutter panel, each of the two adjacent shutter panels has a substantially planar upper edge portion and a substantially planar lower edge portion, the upper and lower edge portions of each of the two adjacent shutter panels intersects with, but is not coplanar with, the planar mid-portion of the respective shutter panel, and the upper edge portion of each of the two adjacent shutter panels extends upward or toward the first side of the shutter and the lower edge portion of each of the two adjacent shutter panels extends downward or toward the second side of the shutter.

Preferably, for each of the two adjacent shutter panels, the substantially planar upper edge portion and the substantially planar lower edge portion are parallel.

In broad terms, a second aspect of the invention comprises a roller shutter assembly comprising the shutter of the first aspect or any of its preferences as defined above, a pair of substantially vertical guide tracks, and a shutter support; wherein the shutter has a pair of opposite substantially parallel side edges which are substantially perpendicular to the upper and lower edges of the shutter panels and are engaged respectively in the guide tracks when the shutter is closed, the shutter support is located in the vicinity spanning the upper ends of the guide tracks, the shutter support rotates about an axis that is substantially parallel to the upper and lower edges of the shutter panels, and when the shutter is opened the shutter is retracted from the guide tracks and tolled about the shutter support.

Preferably, each vertical guide track has a pair of parallel front and tear track walls, and the side edges of the shutter slide up or down between the front and rear track walls of a respective one of the vertical guide tracks to guide the shutter as the shutter moves between shutter open and shutter closed states.

Preferably, the planar upper and lower edge portions at the side edges of the shutter panels are jammed against respective inside faces of the rear and front track walls of a respective one of the vertical guide tracks when the shutter is lowered to a shutter closed state in which a bottom edge of the shutter is supported on a floor or sill and the series of shutter panels are successively supported by one another from below.

The term "comprising" as used in this specification and claims means "consisting at least in part of". That is to say, when interpreting statements in this specification and claims which include "comprising", the features prefaced by this term in each statement all need to be present but other features can also be present. Related terms such as "comprise" and "comprised" are to be interpreted in a similar manner.

This invention may also be said broadly to consist in the parts, elements and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

As used herein the term "and/or" means "and") or "or", or both.

As used herein "(s)" following a noun means the plural and/or singular forms of the noun.

BRIEF DESCRIPTION OF DRAWINGS

The invention will be further described by way of example only and without intending to be limiting with reference to the following drawings wherein.

DETAILED DESCRIPTION

FIGS. 1 to 6 show details of a first embodiment of a louvred shutter assembly. The shutter comprises a series of horizontal shutter panels 10 which are connected together by a plurality of connecting arms 20. Adjacent shutter panels in the series are pivotally connected to one another by at least two of the connecting arms. The shutter slides vertically with the left and right vertical edges of the shutter restrained respectively in left and tight vertical guide tracks. FIGS. 1 to 5 show views of a tight end bottom portion of the shutter and the lower end of the right guide track 30.

Figure 1:
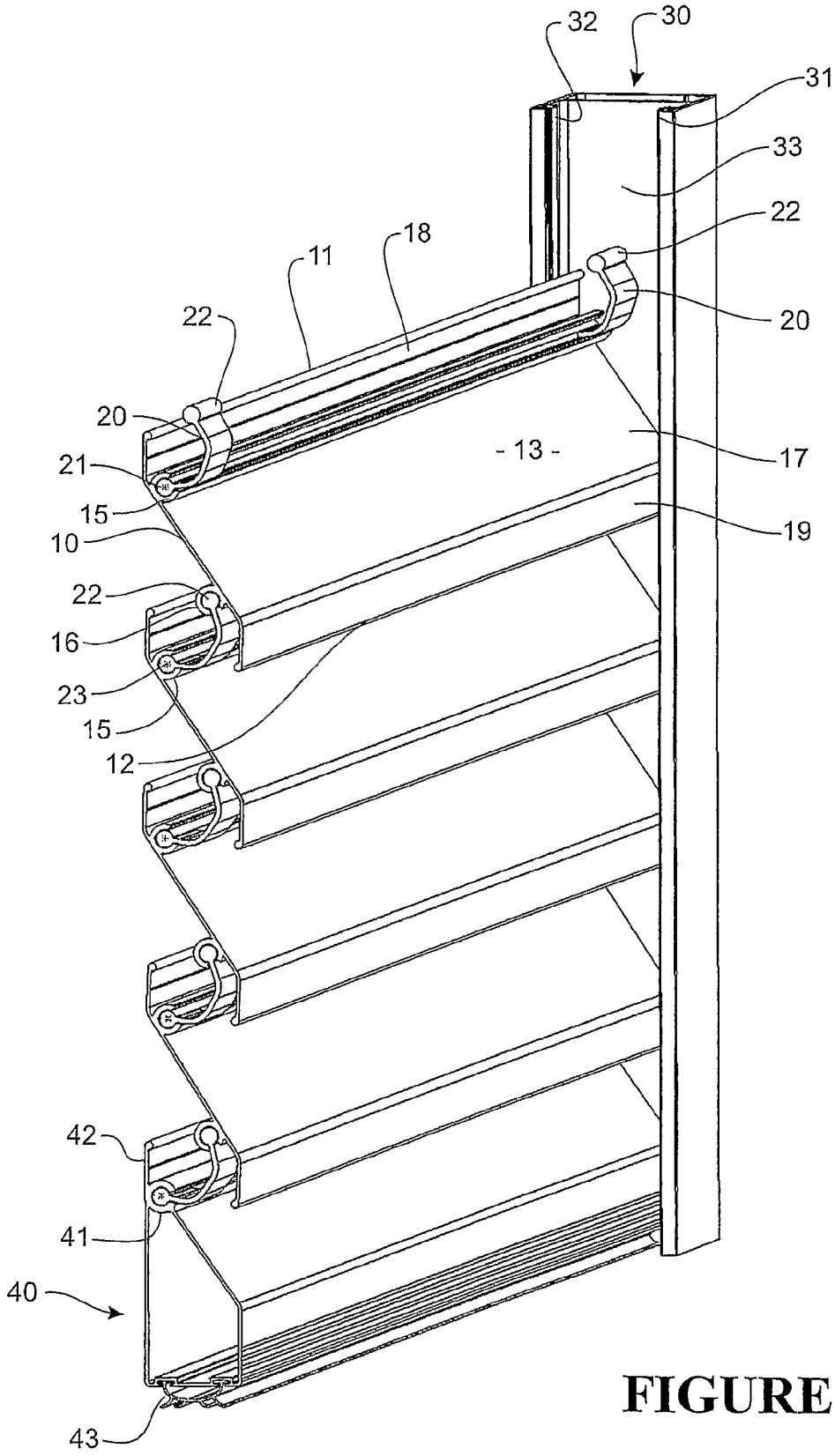
FIG. 1 shows a front perspective view of a sectioned tight end bottom portion of a first louvred shutter and a guide track, according to the invention, in a lowered position.
Figure 3:
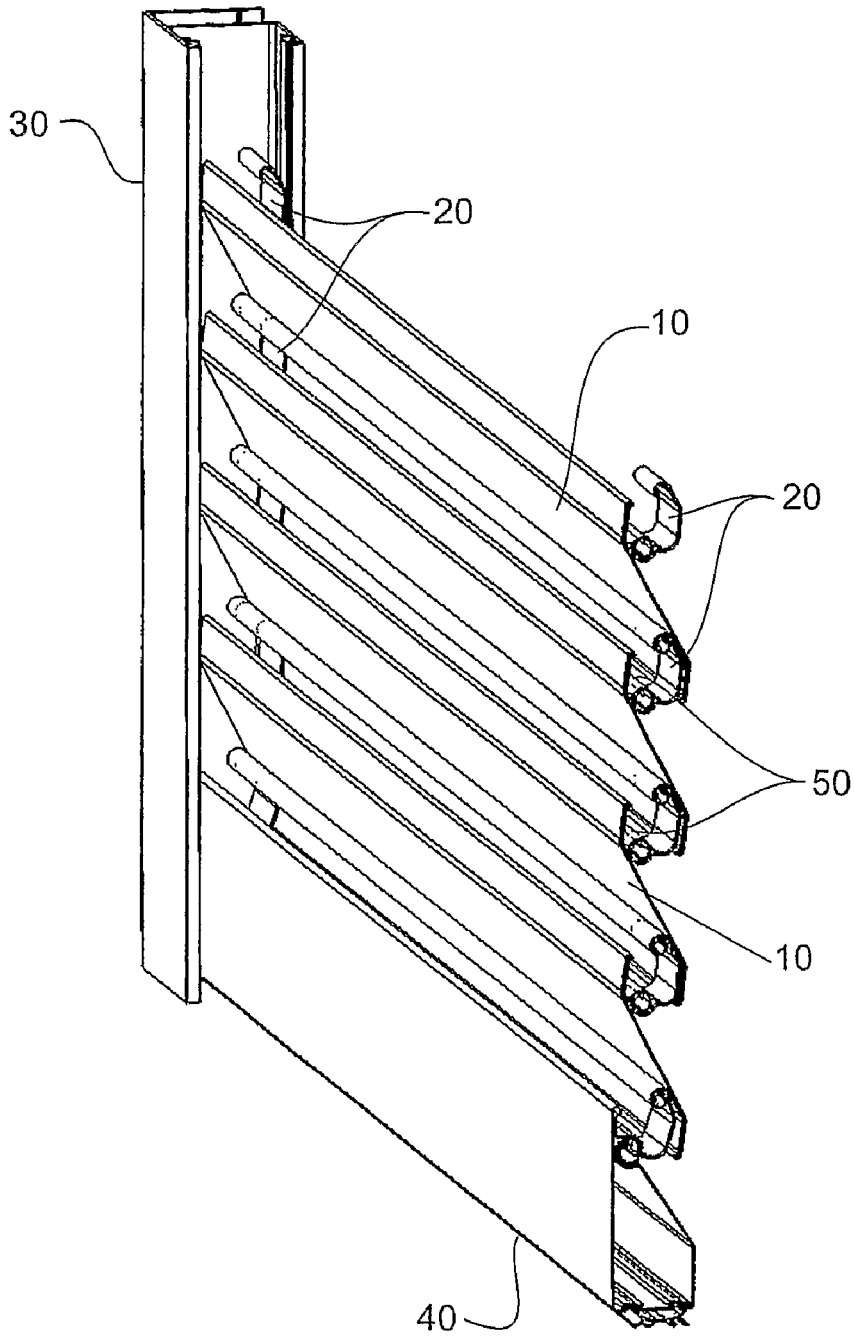
FIG. 3 shows a rear perspective view of a sectioned tight end bottom portion of the louvred shutter and the guide track of FIG. 1, in the lowered position.
Figure 4:
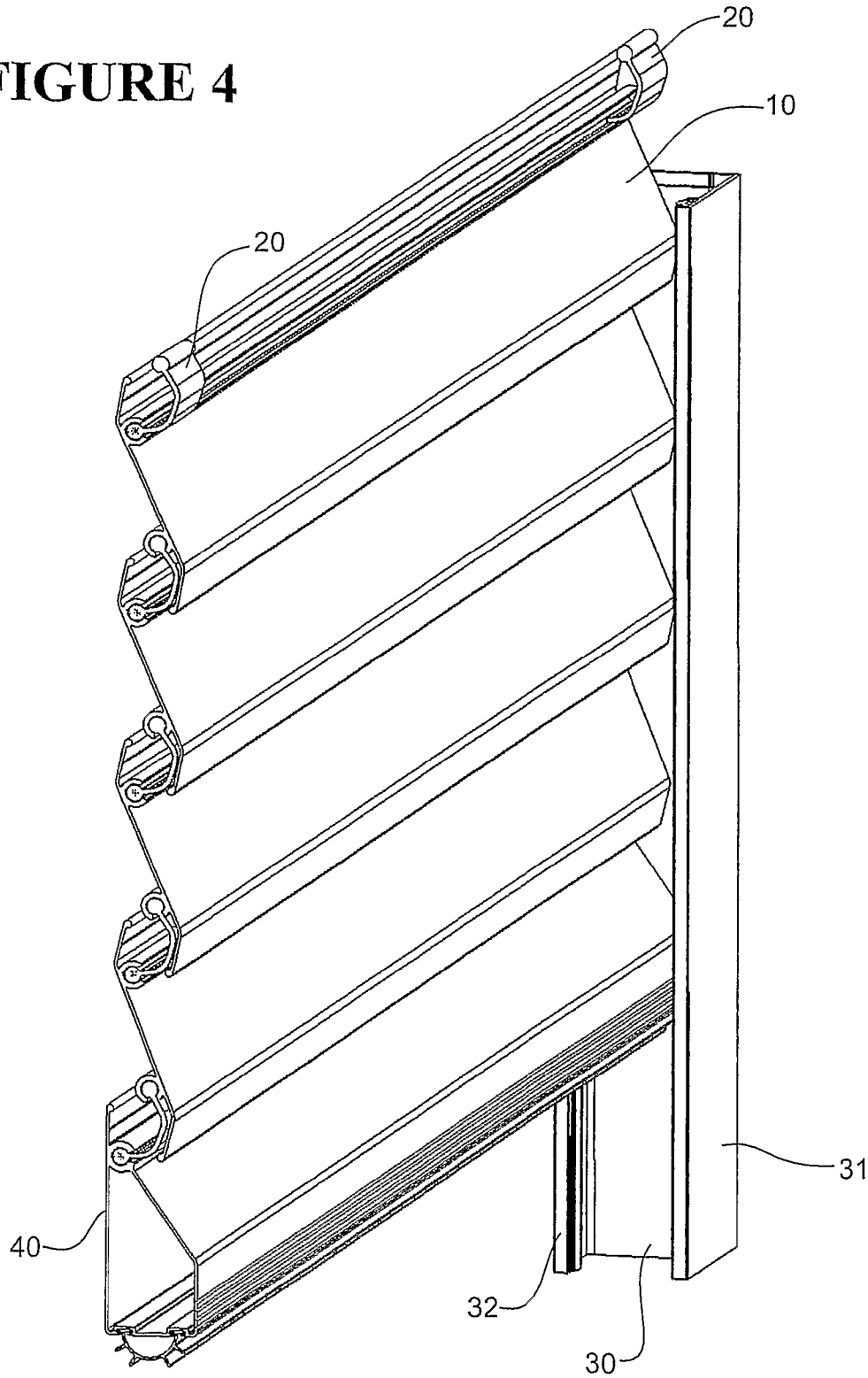
FIG. 4 shows a front perspective view of a sectioned right end bottom portion of the louvred shutter and the guide track of FIG. 1, in a partially raised position.

FIGS. 1 and 4 show front views of a right end bottom portion of the shutter. FIG. 3 shows a rear view of a right end bottom portion of the shutter. References to right and left are to be understood as would be seen by a viewer facing toward the front face of the shutter as seen in FIGS. 1 and 4.

Each shutter panel 10 has an upper edge 11 and a lower edge 12, a first face 13 and a second face 14. The first faces of each shutter panel face to the front or outside of the shutter and the second faces all face to the rear or inside of the shutter. A C-shaped upper pivotal connection 15 is located on the front face 13. A C-shaped lower pivotal connection 16 is located on the rear face 14.

Each connecting arm 20 has an enlarged bead along a lower edge 21 and another enlarged bead along an upper edge 22. The lower edge 21 of the connecting arm 20 is pivotally connected to the upper pivotal connection 15 on the front face 13 of a next lower shutter panel. The upper pivotal connection 15 is spaced below the upper edge 11 of the shutter panel.

The upper edge 22 of the connecting arm 20 is pivotally connected to the lower pivotal connection 16 on the rear face 14 of a next higher shutter panel. The lower pivotal connection 16 is spaced above the lower edge 12 of the shutter panel.

A plurality of the connecting arms 20 pivotally connects adjacent shutter panels 10 together. The connecting arms connecting a pair of adjacent shutter panels are spaced apart along the axes of the pivotal connections between the arms and shutter panels. This spacing provides apertures 50 (shown in FIG. 3) between the connected shutter panels 10, even when the shutter is closed. These apertures provide for ventilation through the closed shutter.

Spacing rods, not shown in the figures, are inserted into the pivotal connections 15, 16 of a shutter panel 10 to maintain the spacing between adjacent connecting arms 20 occupying that pivotal connection. Preferably, connecting arms 20 occupy outer end positions in each pivotal connection 15, 16 to help resist attempts to pry apart the ends of connected shutter panels.

Figure 2:
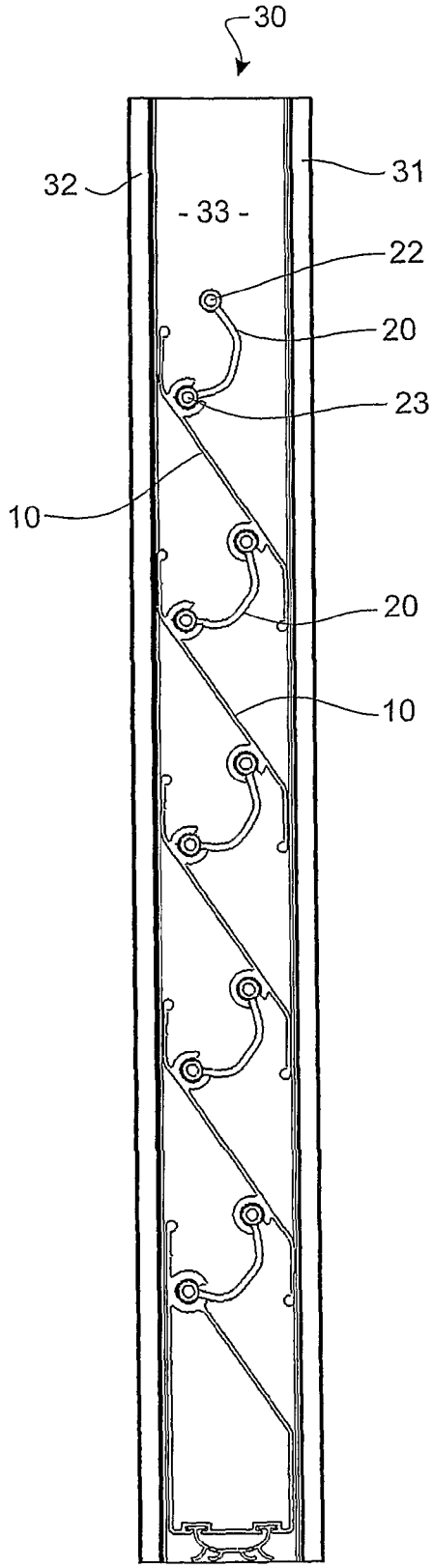
FIG. 2 shows a cross-sectional side view of the right end bottom portion of the louvred shutter and the guide track of FIG. 1, in the lowered position.
Figure 5:
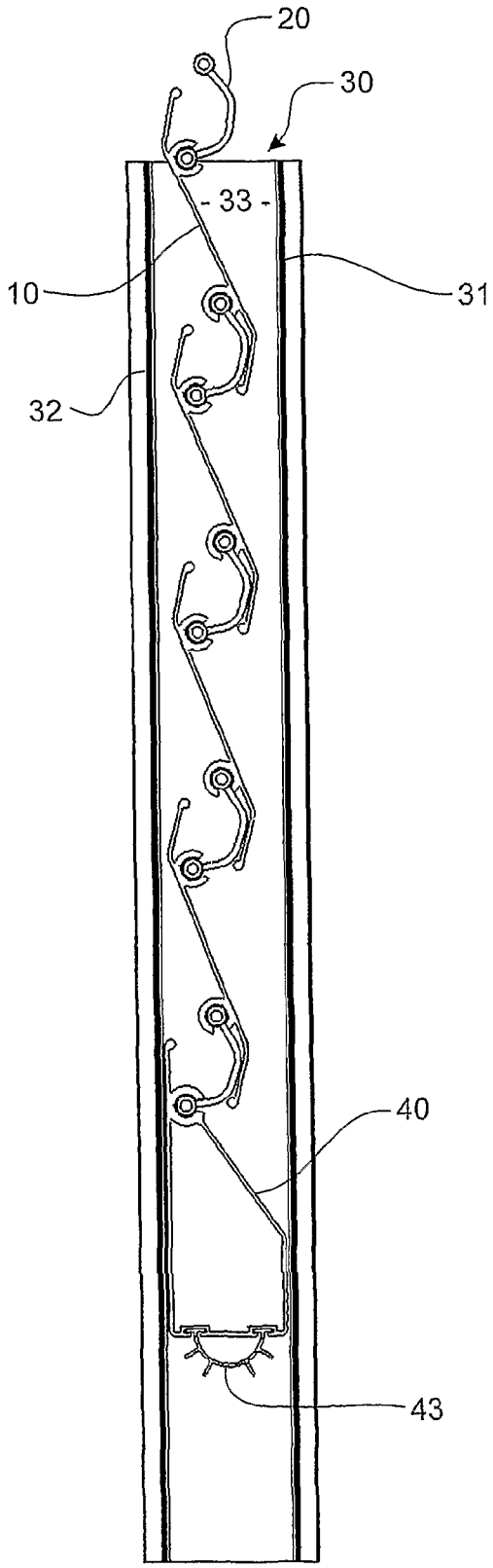
FIG. 5 shows a cross-sectional side view of the tight end bottom portion of the louvred shutter and the guide track of FIG. 1, in the partially raised position.
Figure 6:
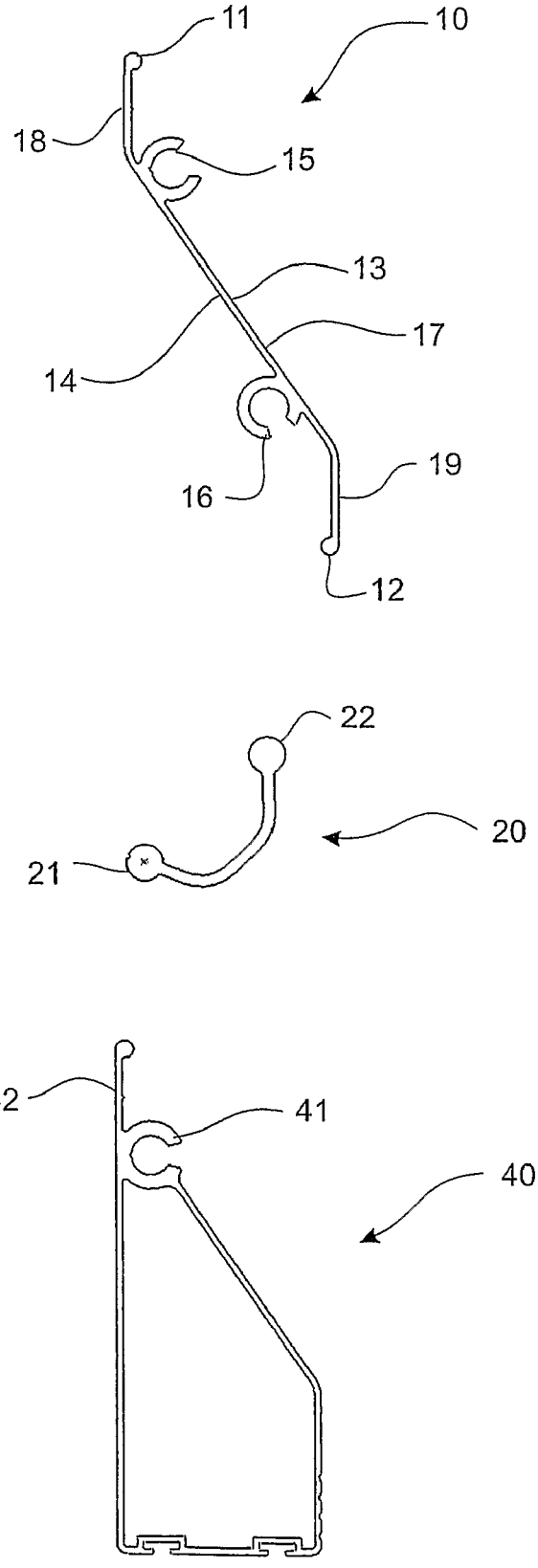
FIG. 6 shows a cross-sectional side view of some components of the louvred shutter of FIG. 1.
Figure 7:
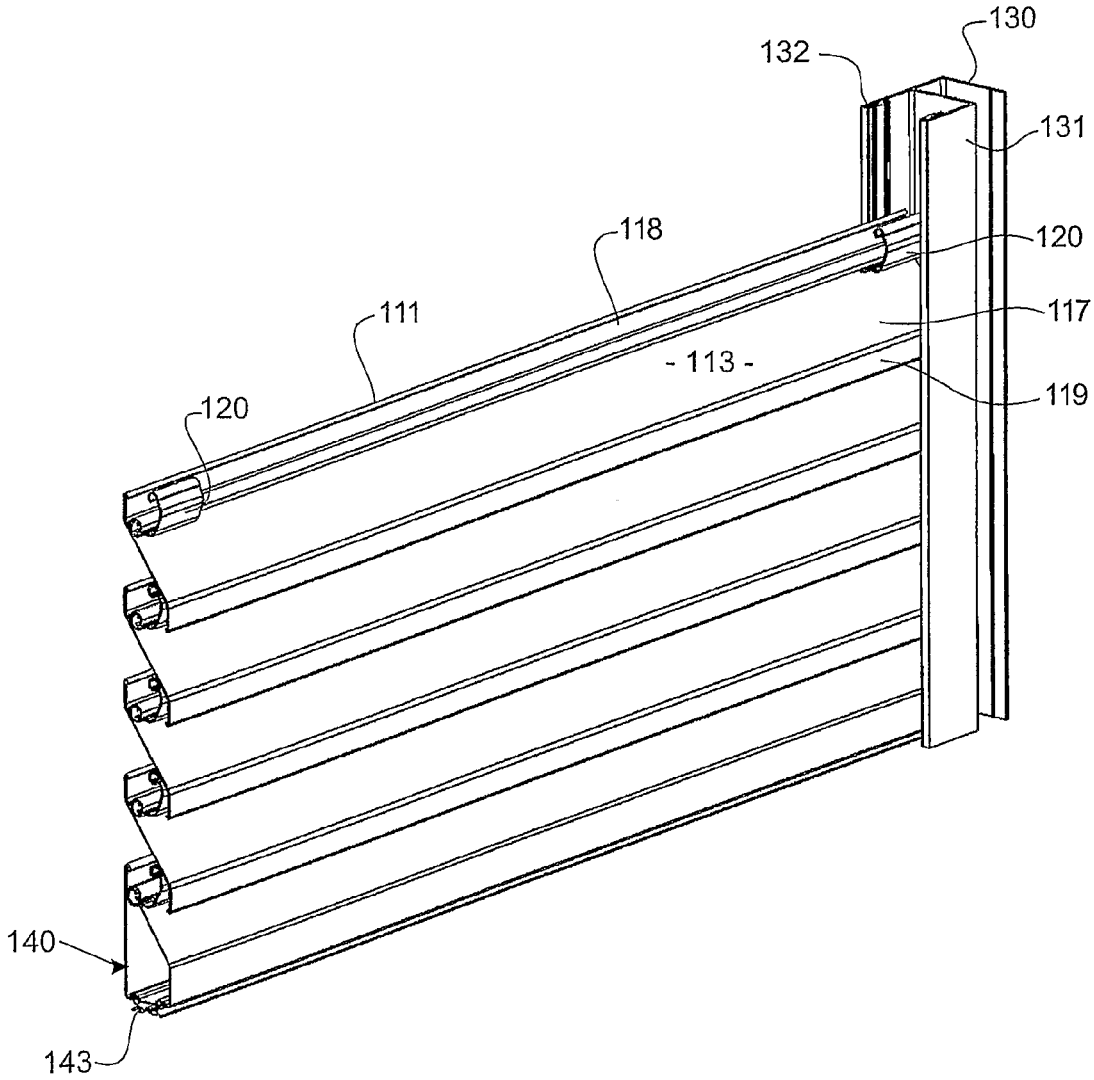
FIG. 7 shows a front perspective view of a sectioned right end bottom portion of a second louvred shutter and a guide track, according to the invention, in a lowered position.
Figure 8:
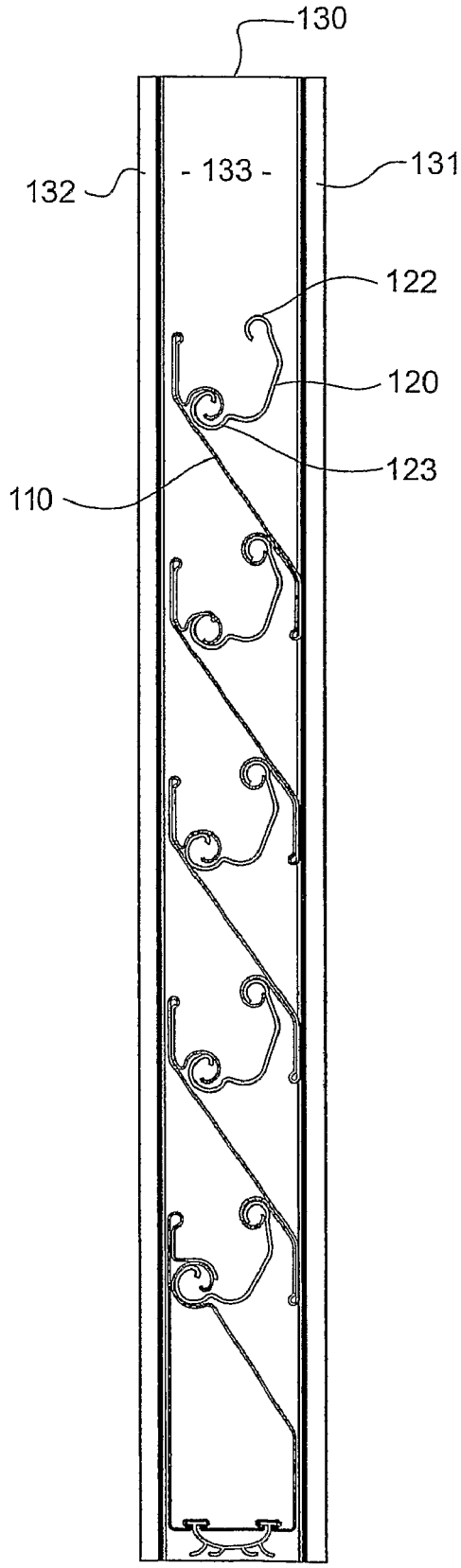
FIG. 8 shows a cross-sectional side view of the right end bottom portion of the louvred shutter and the guide track of FIG. 7, in the lowered position.
Figure 9:
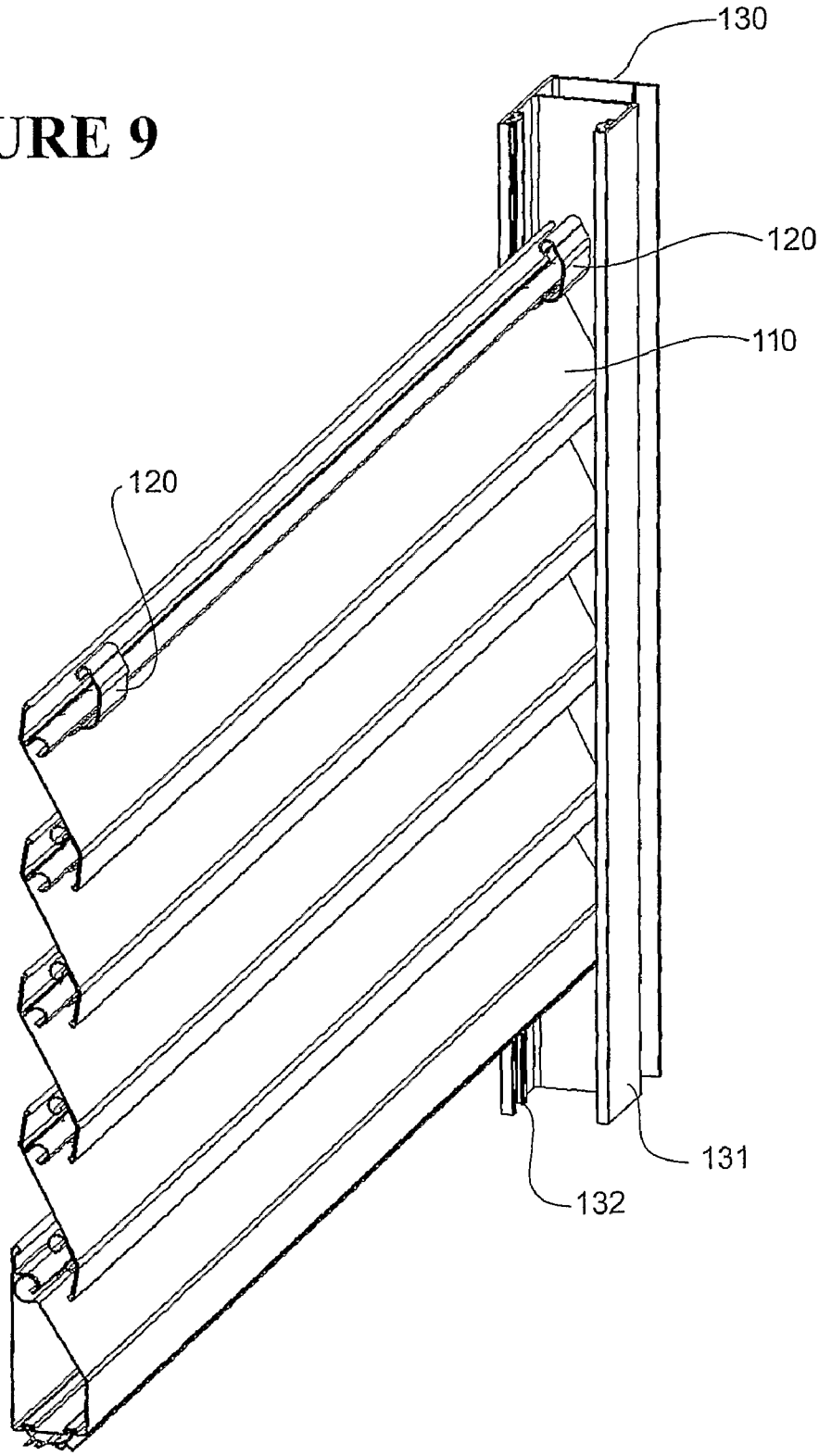
FIG. 9 shows a front perspective view of a sectioned right end bottom portion of the louvred shutter and the guide track of FIG. 7, in a partially raised position.
Figure 10:
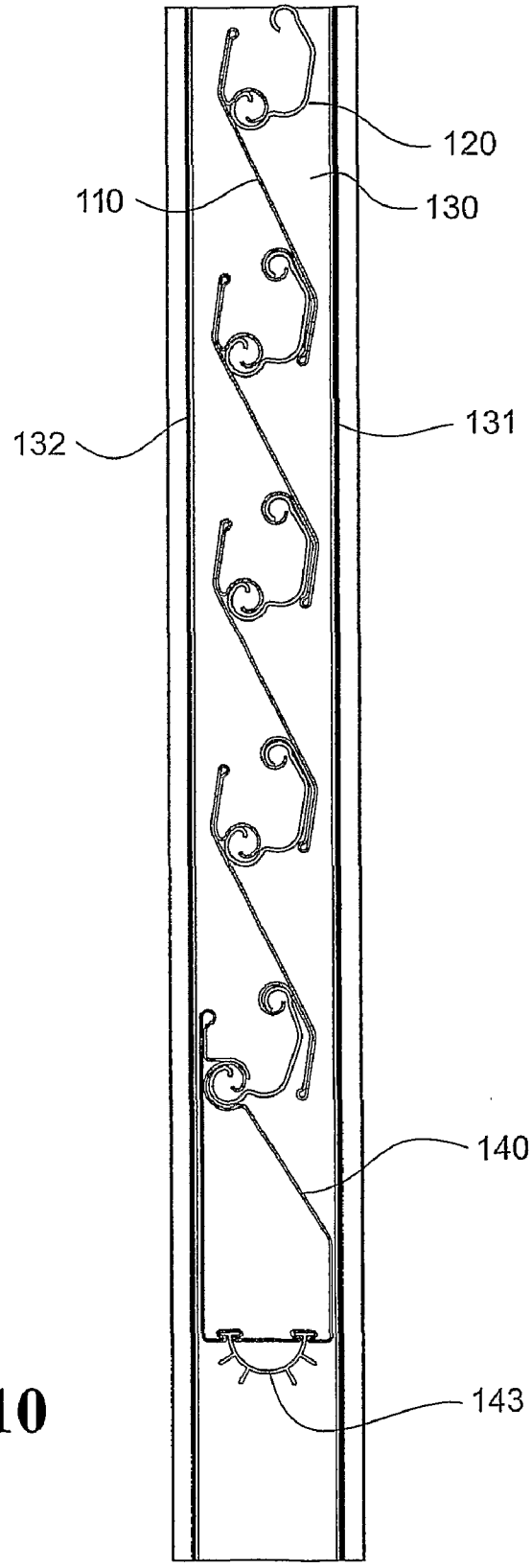
FIG. 10 shows a cross-sectional side view of the tight end bottom portion of the louvred shutter and the guide track of FIG. 7, in the partially raised position.
Figure 11:
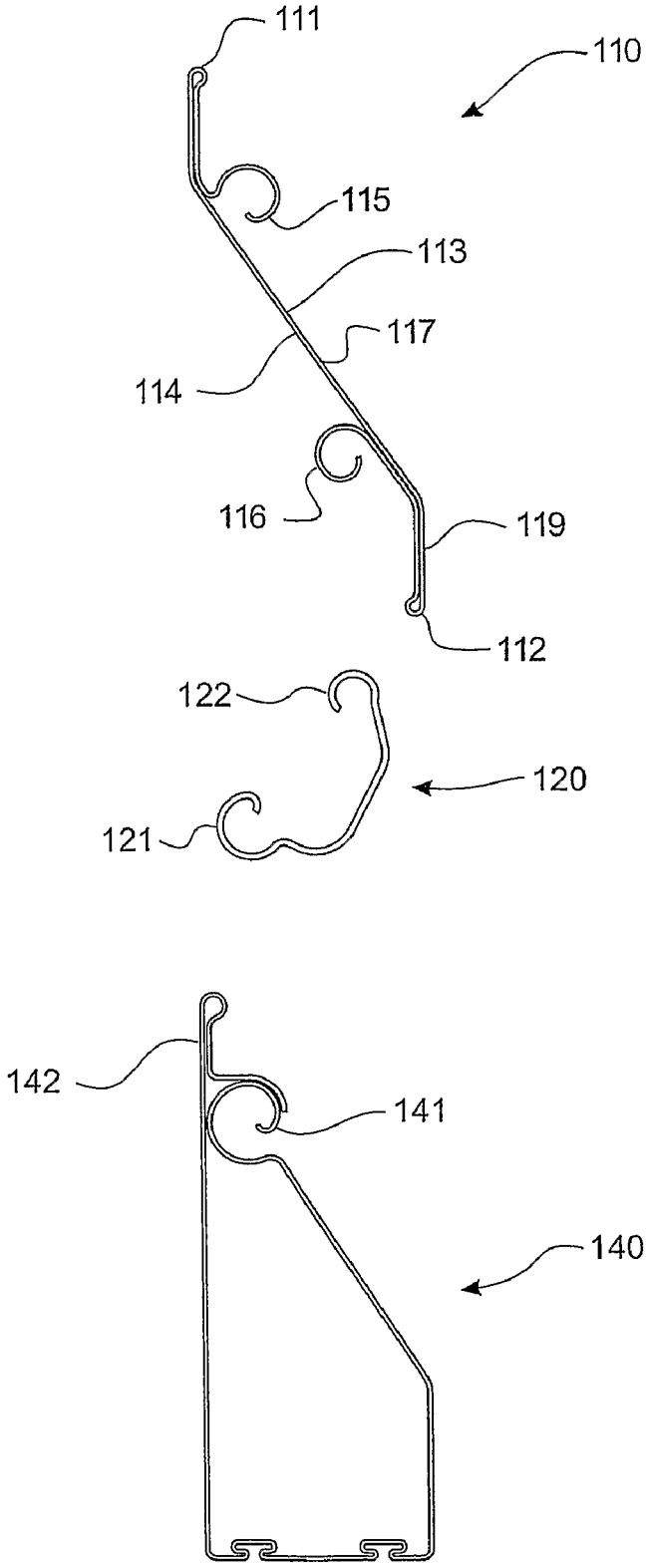
FIG. 11 shows a cross-sectional side view of some components of the louvred shutter of FIG. 7.

In the shutter panels 10 as shown in FIGS. 1 to 6, the upper and lower pivotal connections 15 and 16 lie on respective opposite faces of a planar mid-portion 17 of the shutter panel. The shutter panel also has a planar upper edge portion 18 and a planar lower edge portion 19. Each of these planar edge portions intersect with, but are not coplanar with, the mid-portion 17. The planar upper edge portion 18 extends from its intersection with the mid-portion 17 either vertically upward, as seen ha FIGS. 1 and 2, or in an upward direction sloping toward the front or outside of the shutter, as seen in FIGS. 4 and 5. The planar lower edge portion 19 extends from its intersection with the mid-portion 17 either vertically downward, as seen in FIGS. 1 and 2, or in a downward direction sloping toward the rear or inside of the shutter, as seen in FIGS. 4 and 5. The planar upper and lower edge portions are preferably parallel as may be best seen in the cross-sectional side view shown in FIG. 6.

The shutter panels 10 and connecting arms 20 described above are part of a roller shutter assembly. The assembly also includes a pair of left and right substantially vertical guide tracks 30. Only a right guide track is seen in the figures. The opposite side edges of the shutter are parallel and substantially vertical, and the upper and lower edges 11, 12 of the shutter panels are horizontal. The opposite side edges of the shutter are engaged respectively in the guide tracks 30 when the shutter is closed, as shown in FIGS. 1 to 3, and when partially raised, as shown in FIGS. 4 and 5.

If the length of the lower edge 21 or upper edge 22 of a connecting arm 20 occupying a pivotal connection 15, 16 is greater than the difference between the horizontal distance between the end walls 33 of the two opposite guide tracks 30 and the total length of the spacing rods and the lower edges 21 or upper edges 22 of the connecting arms 20 occupying the pivotal connection 15, 16, then the connecting arms will be captive in the pivotal connection and further restraint to maintain the arms and spacing rods in may be dispensed with.

Alternatively, and more reliably, the upper and lower edges 22, 23 of the connecting arms 20, and the intervening spacing rods, may be retained in the C-shaped pivotal connections 15, 16 by short solid cylindrical retainers, not shown in the figures. A retainer is secured in each outer end of each pivotal connection 15, 16 of each shutter panel. In this case, connecting arms 20 are preferably located immediately inward of the retainers in each pivotal connection 15, 16 to resist attempts to pry apart the ends of connected shutter panels. Each retainer is retained in position in the pivotal connection, for example by an adhesive or, particularly if easy disassembly is required, a transverse grub screw. The use of the retainers is preferred in shutters that extend beyond the top of the guides 30 when rolled up about a shutter support, as will be explained below.

The shutter is suspended from a shutter support, not shown in the figures, which is located in the vicinity spanning the upper ends of the guide tracks 30. The shutter support is rotated about a substantially horizontal axis to raise and lower the shutter. The pivotal connections between the shutter panels 10 and the connecting arms 20 allow the shutter to be rolled about the shutter support 2 as the shutter is raised from the closed position.

Each of the vertical guide tracks 30 has a front wall 31, a rear wall 32 and an end wall 33. The side edges of the shutter slide up or down between the front and rear guide track walls to guide the shutter as the shutter moves between shutter open and shutter closed states.

Any portion of the shutter that is suspended, directly or indirectly, from the overhead shutter support will hang with the shutter panels 10 and connecting arms 20 in a relatively thin configuration, with the side edges of the shutter lying relatively loosely between the front and rear walls 31, 32 of the respective guide tracks 30, as shown in FIGS. 4 and 5. In this relatively thin configuration, the suspended portion of the shutter is freely moveable up and down by rotation of the shutter support.

Conversely, any portion of the shutter that is supported, directly or indirectly, by the floor or sill at the bottom of the shutter opening will sit with the shutter panels 10 and connecting arms 20 in a relatively thick configuration, with the side edges of the shutter jammed relatively tightly between the front and tear walls 31, 32 of the respective guide tracks 30, as shown in FIGS. 1, 2 and 3. In this relatively thick configuration, the portion of the shutter that is supported from below is jammed in the guide track. This jamming action resists rattling of the shutter panels 10 such as by wind pressure, and also helps to resist attempts to raise the shutter by upward pressure on any shutter panel. The jamming action on each shutter panel is automatically released as soon as the shutter panel is lifted from above, such as when the shutter is being opened by being rolled up onto the shutter support.

As the shutter is closed, the shutter panels change successively, from the bottom up, from the relatively thin suspended state to the relatively thick jammed state. Conversely, when the shutter is opened from a fully closed state, the shutter panels change successively, from the top down, from the relatively thick jammed state to the relatively thin suspended state.

When the shutter shown in FIGS. 1 to 6 is closed, as is shown in FIGS. 1, 2 and 3, the planar mid-portion 17 of each shutter panel slopes downward and outward, the upper planar edge portion 18 at each side edge of each shutter panel is jammed substantially vertically against the inside face of the rear wall 32 of the guide tracks 30, and the lower planar edge portion 19 at each side edge of each shutter panel is jammed substantially vertically against the inside face of the front wall 31 of the guide tracks 30.

The pivotal connections between the shutter panels 10 and the connecting arms 20 have sufficient range of angular movement to allow the change of configuration between the relatively thick and relatively thin shutter configurations.

As may be best appreciated from the cross-sectional view of FIG. 2, this shutter adopts a louvre configuration with the lower edge 12 of each shutter panel 10 outside and lower than the upper inside edge 11 of the next lower shutter panel, while simultaneously maintaining the apertures 50 between the shutter panels by the spacing of the connecting arms 20 at each pivotal connection. When the shutter is closed, this louvre formation gives good deflection of tai or other precipitation down the front face of the shutter while maintaining good ventilation of the shutter.

The bottom of the shutter may be fitted with a bottom panel 40 having a pivotal connection 41 and upper edge 42, and a resilient seal 43 to engage the floor or sill when the shutter is lowered to the closed position.

The shutter panels 10, connecting arms 20, guide tracks 30, and bottom shutter panel 40, as depicted in FIGS. 1 to 6, may be extruded from aluminium or an aluminium alloy.

FIGS. 7 to 11 show details of a second embodiment of a louvred shutter assembly. The numbering of parts of the second embodiment has 100 added to the numbering used for like parts of the first embodiment already described above. For example, the shutter panels 110, connecting arms 120, guide tracks 130 and bottom panel 140 of the second embodiment of FIGS. 7 to 11 correspond to like parts 10, 20, 30 and 40 in the first embodiment of FIGS. 1 to 6.

The second embodiment shows a shutter assembly where the shutter panels, 110, connecting arms 120, and bottom panel 140 are manufactured from a sheet material, for example by a sequence of roll forming and folding operations to form the general shapes and the pivotal connections from a flat steel sheet material.

It is to be noted that in this formed sheet embodiment, both the horizontally-extending raw edges of the louvred shutter panels 110 and of the connecting arms 120 lie advantageously under the protection of the next higher shutter panel. The lower and outer 'drip' edge 112 of each louvred shutter panel 110 is a rolled edge which can retain a protective coating, such as galvanising or paint, that can be conveniently applied to the flat sheet material before formation of the shutter panel shape.

The second embodiment otherwise functions in a similar manner to that as already described above for the first embodiment, to provide a louvred shutter formation that can be rolled up to an open configuration and that offers good security and weather-resistant ventilation when closed.

The invention claimed is:

1. A shutter for a roller shutter assembly comprising, in combination:

a series of shutter panels and a plurality of connecting arms;

wherein the shutter panels each have an upper edge and a lower edge, a first face and a second face, the first faces all face to a first side of the shutter and the second faces all face to an opposite second side of the shutter, and wherein each shutter panel has a planar mid-portion, an upper edge portion extending from the planar mid portion to the upper edge and a lower edge portion extending from the planar mid-portion to the lower edge;

the connecting arms each have a lower edge and an upper edge;

the lower edge of each of the at least two connecting arms is pivotally connected to an upper pivotal connection on the planar mid-portion on the first face of the lower of two adjacent shutter panels; and the upper edge of each of the at least two connecting arms is pivotally connected to a lower pivotal connection on the planar mid-portion on the second face of an upper of two adjacent shutter panels.

2. A shutter as claimed in claim 1, wherein:

a lower one of two adjacent shutter panels in the series is pivotally connected to a higher one of the two adjacent shutter panels by at least two of the connecting arms; and the at least two connecting arms are spaced apart along the axes of the pivotal connections between the at least two connecting arms and the upper and lower shutter panels.

3. A shutter as claimed in claim 1, wherein the upper edge portion and the lower edge portion of each shutter panel are parallel.

4. A roller shutter assembly comprising:

a shutter as claimed in claim 1;

a pair of substantially vertical guide tracks; and a shutter support;

wherein the shutter has a pair of opposite substantially parallel side edges which are substantially perpendicular to the upper and lower edges of the shutter panels and are engaged respectively in the guide tracks when the shutter is closed; and wherein the shutter support is located in the vicinity spanning the upper ends of the guide tracks, the shutter support rotates about an axis that is substantially parallel to the upper and lower edges of the shutter panels, and when the shutter is opened the shutter is retracted from the guide tracks and rolled about the shutter support.

5. A roller shutter assembly as claimed in claim 4, wherein each vertical guide track has a pair of parallel front and rear track walls, and the side edges of the shutter slide up or down between the front and rear track walls of a respective one of the vertical guide tracks to guide the shutter as the shutter moves between shutter open and shutter closed states.

6. A roller shutter assembly comprising a shutter as claimed in claim 1, a pair of substantially vertical guide tracks, and a shutter support;

wherein the shutter has a pair of opposite substantially parallel side edges which are substantially perpendicular to the upper and lower edges of the shutter panels and are engaged respectively in the guide tracks when the shutter is closed, the shutter support is located in the vicinity spanning the upper ends of the guide tracks, the shutter support rotates about an axis that is substantially parallel to the upper and lower edges of the shutter panels, and when the shutter is opened the shutter is retracted from the guide tracks and rolled about the shutter support.

7. A roller shutter assembly as claimed in claim 6, wherein each vertical guide track has a pair of parallel front and rear track walls, and the side edges of the shutter slide up or down between the front and rear track walls of a respective one of the vertical guide tracks to guide the shutter as the shutter moves between shutter open and shutter closed states.

8. A roller shutter assembly comprising a shutter as claimed in claim 3, a pair of substantially vertical guide tracks, and a shutter support; wherein the shutter has a part of opposite substantially parallel side edges which are substantially perpendicular to the upper and lower edges of the shutter panels and are engaged respectively in the guide tracks when the shutter is closed, the shutter support is located in the vicinity spanning the upper ends of the guide tracks, the shutter support rotates about an axis that is substantially parallel to the upper and lower edges of the shutter panels, and when the shutter is opened the shutter is retracted from the guide tracks and rolled about the shutter support.

9. A roller shutter assembly as claimed in claim 8, wherein each vertical guide track has a pair of parallel front and rear track walls, and the side edges of the shutter slide up or down between the front and rear track walls of a respective one of the vertical guide tracks to guide the shutter as the shutter moves between shutter open and shutter closed states.

10. A roller shutter assembly as claimed in claim 9, wherein the planar upper and lower edge portions at the side edges of the shutter panels are jammed against respective inside faces of the rear and front track walls of a respective one of the vertical guide tracks when the shutter is lowered to a shutter closed state in which a bottom edge of the shutter is supported on a floor or sill and the series of shutter panels are successively supported by one another from below.

* * * * *